US005722217A

United States Patent [19]

Cloud

[11] Patent Number: 5,722,217

[45] Date of Patent: Mar. 3, 1998

[54] METHOD AND APPARATUS FOR CONTINUOSUSLY FORMING, FILLING AND SEALING PACKAGES WHILE LINKED TOGETHER

[75] Inventor: Charles E. Cloud, Northbrook, Ill.

[73] Assignee: Cloud Corporation, Des Plaines, Ill.

[21] Appl. No.: 560,123

[22] Filed: Nov. 17, 1995

[51] Int. Cl.[6] ..... B65B 9/08; B65B 43/04; B65B 51/16

[52] U.S. Cl. ..... 53/455; 53/468; 53/477; 53/385.1; 53/386.1; 53/562

[58] Field of Search ..... 53/455, 562, 468, 53/469, 477, 568, 385.1, 386.1, 384.1, 374.4, 374.5, 374.3, 479; 493/208, 197, 196, 195, 194, 193

[56] References Cited

U.S. PATENT DOCUMENTS

| | | | |
|---|---|---|---|
| Re. 28,350 | 3/1975 | Lerner | 53/386.1 X |
| 2,923,111 | 2/1960 | Selock | 53/386.1 X |
| 3,022,912 | 2/1962 | Vincent | 53/386.1 X |
| 3,453,799 | 7/1969 | Cloud et al. | 53/455 |
| 3,478,492 | 11/1969 | Cloud et al. | 53/562 X |
| 3,505,776 | 4/1970 | Cloud . | |
| 3,597,898 | 8/1971 | Cloud | 53/562 X |
| 3,667,188 | 6/1972 | Benner, Jr. et al. | 53/455 X |
| 4,344,269 | 8/1982 | Dieterlen et al. | 53/455 X |
| 4,512,136 | 4/1985 | Christine | 53/455 X |
| 4,945,713 | 8/1990 | Widenback | 53/385.1 X |
| 5,174,088 | 12/1992 | Focke et al. | 53/455 X |
| 5,502,952 | 4/1996 | Wildmoser | 53/455 |

*Primary Examiner*—James F. Coan
*Attorney, Agent, or Firm*—Meroni & Meroni

[57] ABSTRACT

A method of continuously forming, filling and sealing of packages with a continuous web of polyethylene film material is disclosed and comprises the steps of folding the web to provide confronting sides joined along a bottom edge and sealing by training the web onto a vertical seal former having plurality of vertical sealers and progressively forming each vertical seal as the web is being continuously moved with the vertical sealer while at the same applying a low temperature sealing action to allow the area of the film being sealed to be progressively cooked. This process forms a series of horizontally disposed pouches severed by the vertical seals extending transversely of the web leaving sealed side edges of each pouch partially severed from one another with upper portions of each pouch also remaining connected with adjoining pouches and having opposed sidewalls of each pouch unsealed along a top edge preparatory to filling. Opened pouches are then filled prior to sealing a top portion of the opposed sidewalls of each pouch together to enclose the filled pouches with a final pouch closing seal there after added. A packaging apparatus is also provided for continuously forming filled and sealed packages, each having an expanded bottom end capable of receiving a greater amount of fill.

60 Claims, 13 Drawing Sheets

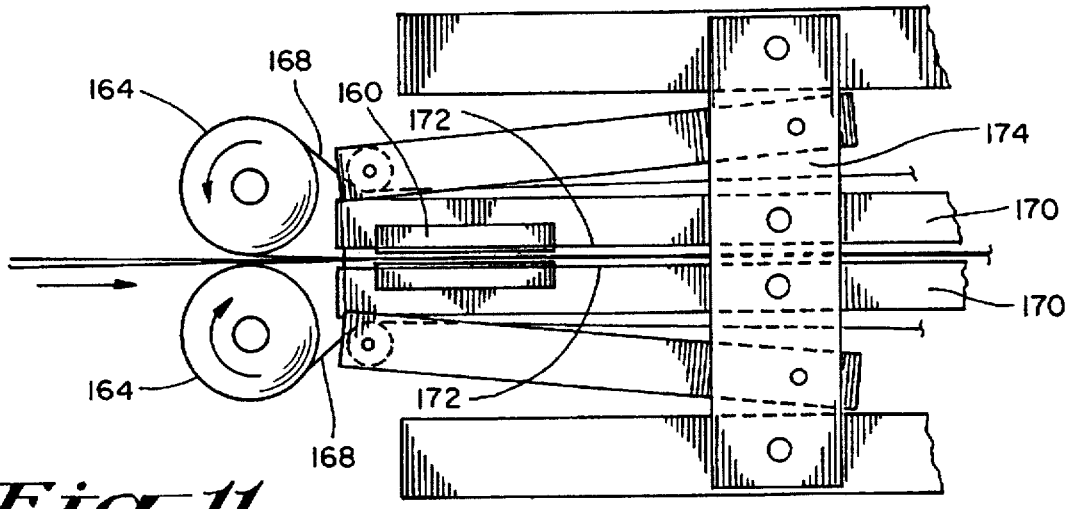
Fig. 11
Fig. 12
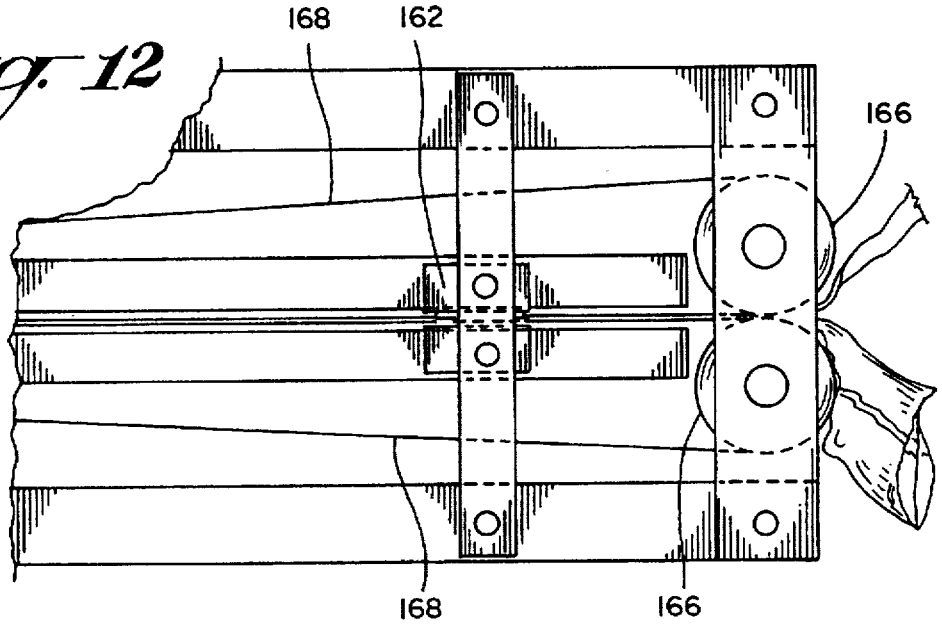
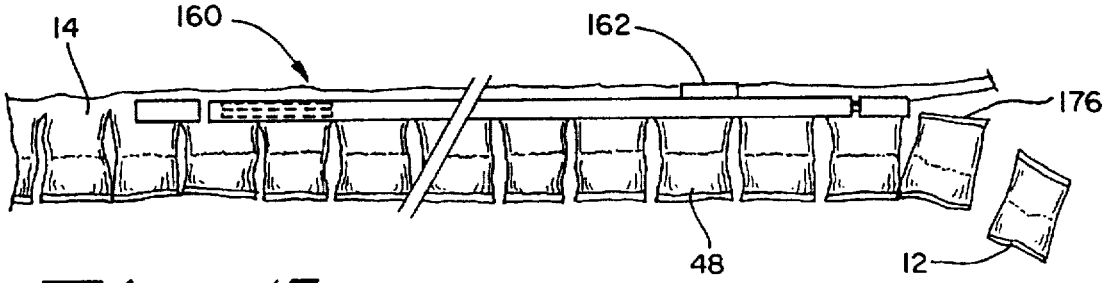
Fig. 13

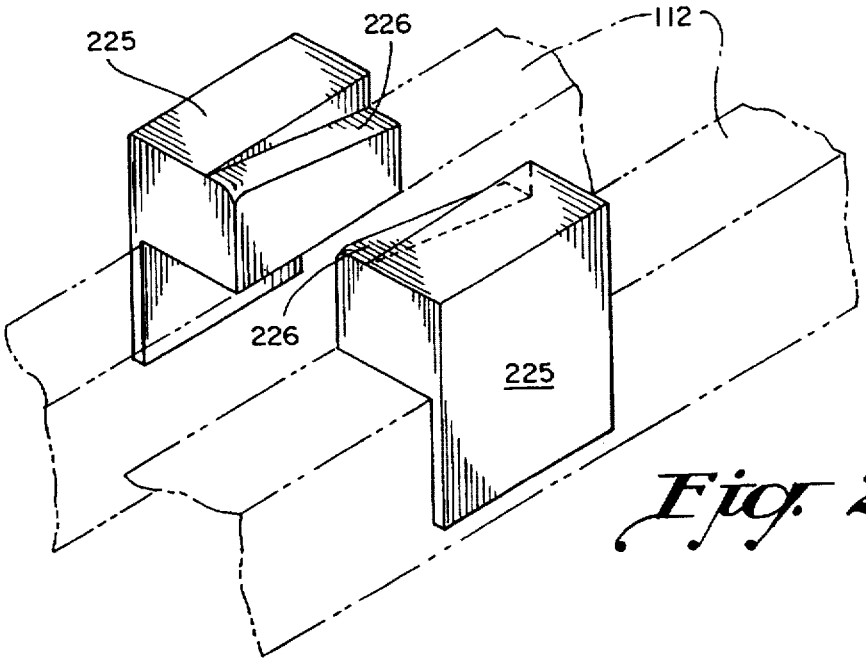
Fig. 21
Fig. 22
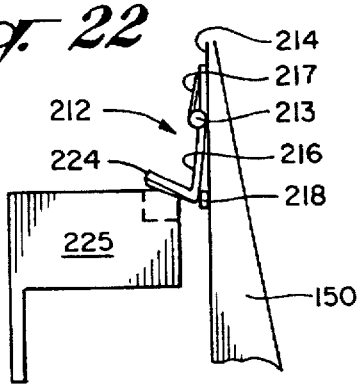
Fig. 23
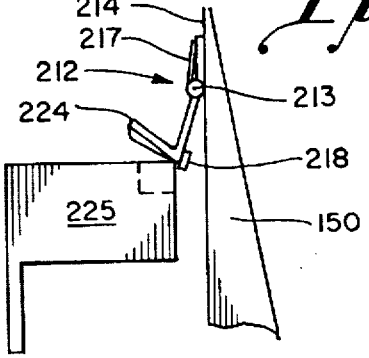
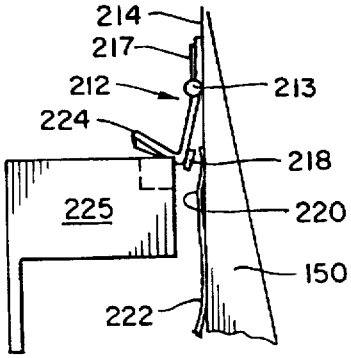
Fig. 24
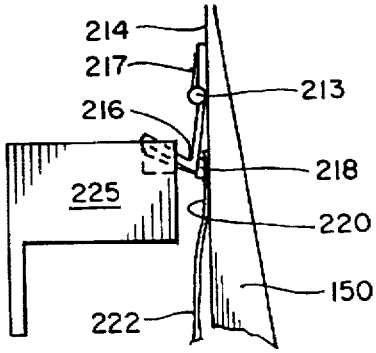
Fig. 25

METHOD AND APPARATUS FOR CONTINUOSUSLY FORMING, FILLING AND SEALING PACKAGES WHILE LINKED TOGETHER

BACKGROUND OF THE INVENTION

1. Field of the Invention

The present invention relates to an improved packaging machine. More particularly, the invention pertains to an improved method and apparatus for continuously forming, filling and sealing packages while linked together to a continuous web of material.

2. Description of the Prior Art

Various prior art packaging machines devices are known in the art. In general, packaging machines are categorized into horizontal and vertical machines depending on the general direction of movement of a continuous web of material. The present invention relates to horizontal packaging machine and is designed to operate in a continuous manner.

In the manufacturing and production of packaged goods, cost factors are highly related to the costs of materials. In the group of materials commonly found in continuous webs of film material, polyethylene is a heat fusible synthetic film that has a relatively low cost in comparison to other film materials. However, traditional packaging methods do not work when using polyethylene. With these principles in mind, the present machine was developed to produce polyethylene packages on large production basis to be used for packaging products such as food powders. The machine and method further enables packages to be formed having an expanded capacity for receiving a greater volume of fill.

A number of U.S. patents have issued to the above-identified inventor concerning various packaging machine methods and apparatuses, with the following list being only a brief representative list of some issued patents to serve as additional background information in field of continuously operating horizontal packaging machines:

| U.S. Pat. No. | Inventor | Date of Issue |
|---|---|---|
| 3,453,799 | Cloud et al. | July 8, 1969 |
| 3,478,492 | Cloud et al. | November 18, 1969 |
| 3,505,776 | Cloud | April 14, 1970 |
| 3,579,898 | Cloud | August 10, 1971 |

As will be described in greater detail hereinafter, the method and apparatus of the present invention differs from those previously proposed and employs a number of novel features that render it highly advantageous over the prior art.

SUMMARY OF THE INVENTION

The invention relates to horizontal packaging machine and is designed to operate in a continuous manner utilizing a continuous web of fill material for automatically forming, filling and sealing packages.

Accordingly, it is an object of this invention to provide an improved method and apparatus for manufacture of filled packages from a continuous web of material, which packages are formed, filled and sealed while linked together to the web.

Another object of this invention is to provide an improved method and apparatus for manufacture of filled packages from a polyethylene material to provide for especially inexpensive packaging costs.

Another object of this invention is to provide an improved method and apparatus for manufacture of filled packages having a pull-apart horizontal seal for easy opening of a filled package.

Another object of this invention is provide pouches that can be filled to a greater extent than traditional pouches so that the pouches are bulged in shape.

Still another object of this invention is to provide a new method and apparatus for forming vertical seals in the web to provide a series of pouches only partially severed by the vertical seals from one another preparatory to filling with only upper portions of each being connected with adjoining pouches during a filling operation.

Still another object of this invention is to provide a packaging machine for continuously forming filled pouches with a new and improved pouch opening station using suction applied to opposite outer surfaces of the opposed sidewalls of each pouch to open the sidewalls of the pouch to facilitate filling.

Still another object of this invention is to provide a new method and apparatus for holding open pouches in engagement with a filling funnel during filling.

Yet another object of this invention relates to new type of packaging machine for continuously forming filled pouches with a new type of trimming station whereby the filled and sealed pouches are severed from the web simultaneously as the upper portion of the web is cut away.

To achieve the foregoing and other objectives, and in accordance with the purposes of the present invention a method and apparatus of continuously forming, filling and sealing of packages with a continuous web of polyethylene film material is provided. The method includes the steps of folding the web to provide confronting sides joined along a bottom edge and sealing by training the web onto a vertical seal former having plurality of vertical sealers and progressively forming each vertical seal as the web is being continuously moved with the vertical sealer while at the same applying a low temperature sealing action to allow the area of the film being sealed to be progressively cooked. This process forms a series of horizontally disposed pouches severed by the vertical seals extending transversely of the web leaving sealed side edges of each pouch severed from one another with upper portions of each pouch being connected with adjoining pouches and having opposed sidewalls of each pouch unsealed along a top edge. Opened pouches are then filled prior to sealing a top portion of the opposed sidewalls of each pouch together to enclose the filled pouches. Upper portions are then trimmed from the web to simultaneously sever the filled and sealed pouches from the web.

In accordance with an aspect of the invention, the web has a surface coated with a peelable substance and the step of sealing the top edges of the opposed sidewalls of each pouch together to enclose the filled pouches provides for confronting sides coated with the peelable substance to remain separable after being sealed together.

In accordance with another aspect of the invention, the vertical seal former includes a sealing drum with a plurality of circumferentially spaced sealing wires. The sealing wires electrically connected in series. An electrical current being applied to the sealing drum to generate a first electrical path between a first set of sealing wires and a second electrical path between a second set of sealing wires. Each sealing wire progressively moving through the first set and the second set as the sealing drum rotates.

In accordance with still another aspect of the invention, pouches are opened by providing a rotating a pair of vacuum belts mounted adjacent to one another to provide an elongated channel therebetween. The vacuum belts each having a plurality of equally spaced apart vacuum ports extending around an outer surface of each vacuum belt. A suction force is applied through the vacuum ports of each vacuum belt when the vacuum belt travels through the elongated channel. The web is then directed through the elongated channel so that each successive vacuum port is in approximate horizontal alignment with a center portion of a successive pouch to provide opening of the pouch as opposite outer surfaces of the opposed sidewalls of each pouch are progressively pulled apart by the suction force through the vacuum port.

Other objects, features and advantages of the invention will become more readily apparent upon reference to the following description when taken in conjunction with the accompanying drawings, which drawings illustrate several embodiments of the invention.

BRIEF DESCRIPTION OF THE DRAWINGS

In the drawings:

FIG. 11 is an enlarged fragmentary top plan view of the horizontal sealer station taken along line 11—11 of FIG. 4;

FIG. 12 is an enlarged fragmentary top plan view of the trimming station taken along line 12—12 of FIG. 4;

FIG. 13 is a diagrammatic side view of the horizontal sealer station and trimming station;

FIG. 21 is a perspective view of a pair of actuating blocks having tracks;

FIG. 22 is a perspective view of a mechanical clip in a closed position before engagement with the track of the actuating block;

FIG. 23 is a perspective view of a mechanical clip being actuated into an open position as it engages against the track of the actuating block;

FIG. 24 is a perspective view of a mechanical clip as it moves along the track of the actuating block;

FIG. 25 is a perspective view of a mechanical clip in a closed position to secure the upper portion of pouch against the funnel.

DETAILED DESCRIPTION OF THE PREFERRED EMBODIMENT

Figure 1:
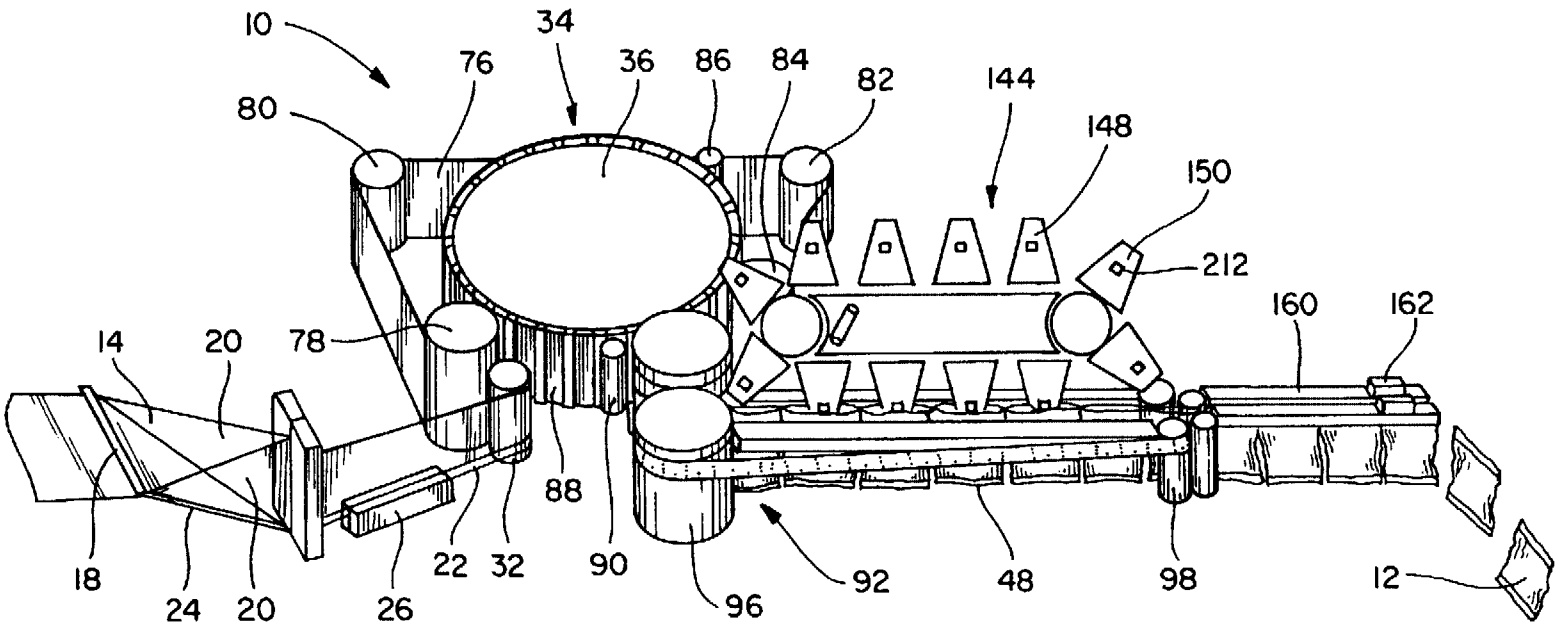
FIG. 1 is a diagrammatic perspective view of the present invention.

Referring now to the drawings, a packing machine 10 is illustrated in FIG. 1. The present machine 10 is horizontal type packaging machine and is capable of producing packages 12 at a high rate of production. The packages 12 are produced from a continuous strip or web of film material 14 or from several continuous webs of film materials as desired. The web is formed of polyethylene film material, which provides an inexpensive packaging material. Additionally, the web may be pre-printed. For purposes of clarity, the term polyethylene should also include any polyethylene type materials having similar properties and characteristics, which are known as fusible film material.

In one preferred embodiment, the web to be use in the this packaging is coated with a peelable substance, such as ZEELON 318 which is a coextruded cast HDPE/LDPE/EVA film having gauge of 1.75 mil. However, it is to be understood that other types peelable substances or films could also be used. When the peelable substance is used during in the sealing process it enables the laminations of the film to be peeled apart. The separation can involve the separation of one coating on one lamination from the other coating on a confronting lamination. With other types of peelable film, the film stock itself is severed so that the separation would not necessary occur strictly between confronting layers of peelable coating. Thus, the characteristics of the peeling action depend on the coating and material used. As will be later described, the use of peelable substance allows for the creation of a separable or pull-apart seal which is highly desirable for packages filled with powder or other materials to allow for easy opening.

Figure 2:
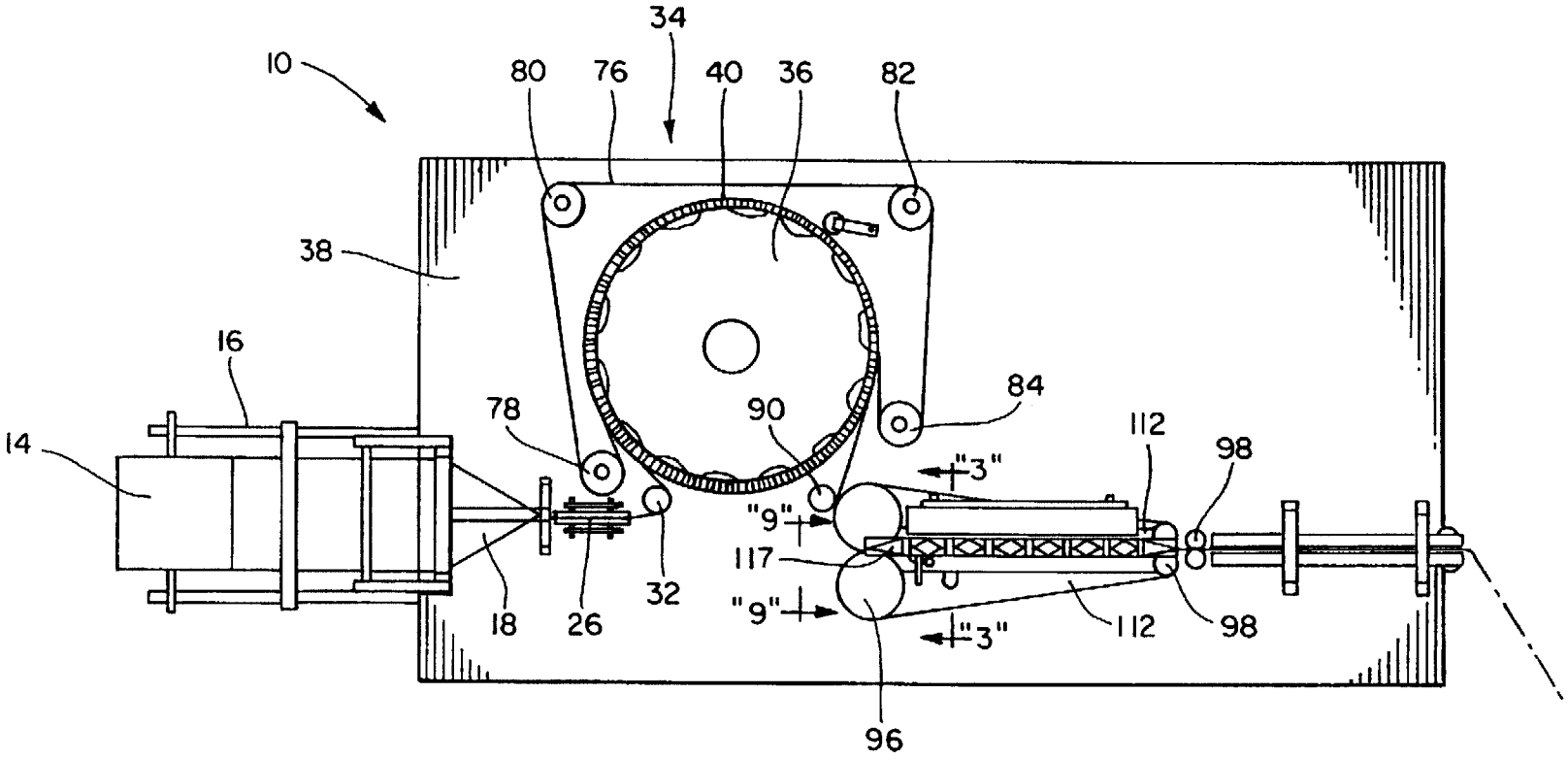
FIG. 2 is a top plan view of the present invention.

Referring to FIG. 2, a coiled roll of the continuous web 14 of film material is mounted for rotation on a frame 16. A suitable strip plow 18 is connected to the frame 16 for folding the web 14 to provide confronting sides 20 joined along a bottom edge 22 (FIG. 1) of the web 14.

In an alternative embodiment, the web 14 is coated with the peelable substance as above-described. A strip knife 24 of conventional type is connected to the plow 18 for severing the bottom edge 22 of the web 14 to produce two separate confronting sides 20 having confronting surfaces of coated substance. The confronting sides 20 are then directed through a horizontal sealer 26, which is a hot bar heat sealer of conventional type.

Figure 15:
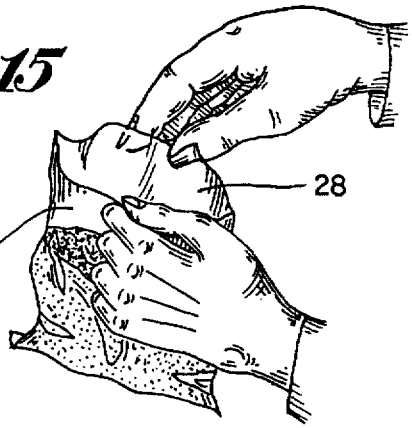
FIG. 15 is a perspective view of a package produced by the present invention having a pull-apart seal.
Figure 16:
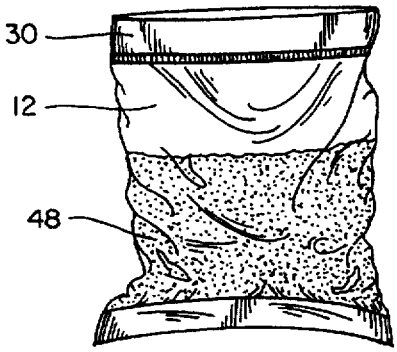
FIG. 16 is a perspective view of a package produced by the present invention having a permanent seal.

It has been found that a temperature of approximately 160° F. used with ZEELON 318 film having a gauge of 1.75 mil produces a low temperature or peel apart seal 28 sufficient for sealing the confronting sides along the bottom edge 22 so that the confronting sides coated with the peelable substance can be peeled apart, as illustrated in FIG. 15. The use of a peel apart seal 28 along a bottom edge 22 is highly advantageous when packaging products such as food powders. During a later occurring filling process, the surfaces of the web 14 may become dusted with a thin layer of this product which would weaken the low temperature seal 28. However, when packaging products such as nuts or bolts, this peel apart seal 28 may be applied along a top edge 30. When a peel apart seal 28 is not desired, the above described strip knife 24 and horizontal sealer 26 are not needed and the originally formed V-shaped bottom edge 22 replaces the need for the seal 28.

Figure 5:
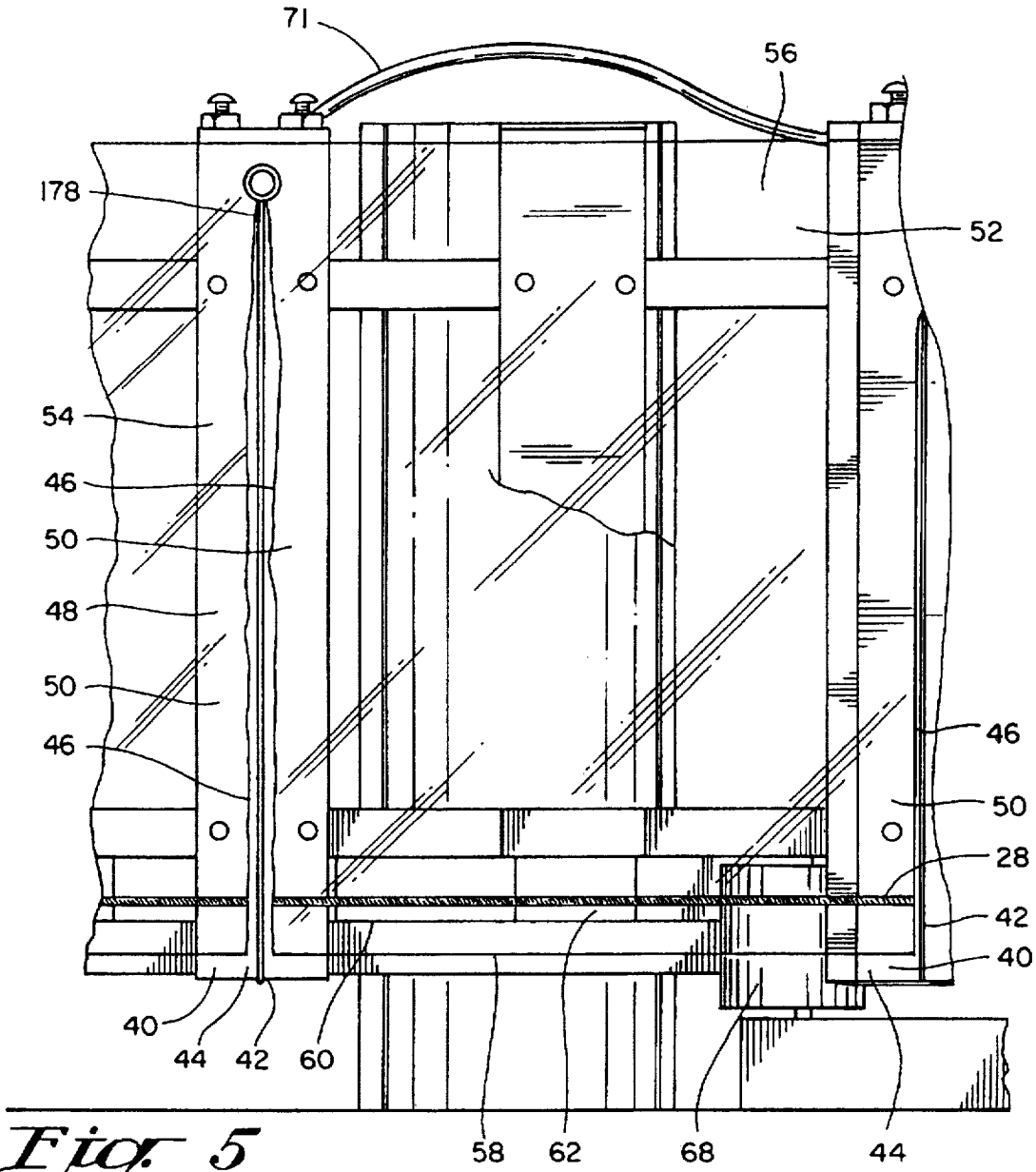
FIG. 5 is an enlarged fragmentary side view of a vertical sealing drum of the present.

Referring to FIG. 2, a guide roller 32 directs the web onto a vertical seal former 34. The vertical seal former 34 has a commutator or sealing drum 36 mounted for rotation to table 38. The sealing drum 36 has a plurality of elongated circumferentially spaced vertical sealers 40 mounted to an outside surface of the sealing drum, as best illustrated in FIG. 5. Referring to FIG. 5, each vertical sealer 40 has a sealing wire 42 extending longitudinally and mounted to an outer sealer surface 44 of the vertical sealer 40. Each sealing wire 42 being in pressing engagement with the web 14 which extends around the sealing drum 36.

In the formation of vertical seals 46, the sealing wires 42 are pressing against the web 14 to progressively form vertical seals 46 as the web 14 is being continuously moved with the vertical sealer 40 while at the same time applying a low temperature sealing action to allow the area of the film being sealed to be progressively formed or cooked. As the vertical seals are formed, the confronting sides 20 of the web 14 are melted together along the sealing wire 42, with the sealing wire then melting through the web 14 to have formed a vertical seal 46 along each adjacent side of the sealing wire 42. Once the vertical seals 46 have been completed, a series of horizontally disposed pouches 48 have been produced. The pouches 48 are partially severed from one another by the vertical seals 46 extending transversely of the web 14. Hence, side edges 50 of each pouch 48 are severed from adjoining pouches with upper portions 52 of each pouch 48 being connected with adjoining pouches and having opposed sidewalls 54 of each pouch unsealed along a top edge 56. As best illustrated in FIG. 5, the vertical seals 46 extend from a bottom edge 58 of the pouch 48 to the upper portion 52 of the pouch 48 and do not extend transversely across the entire web surface so that each pouch 48 will still be connected with adjoining pouches 48.

Figure 14:
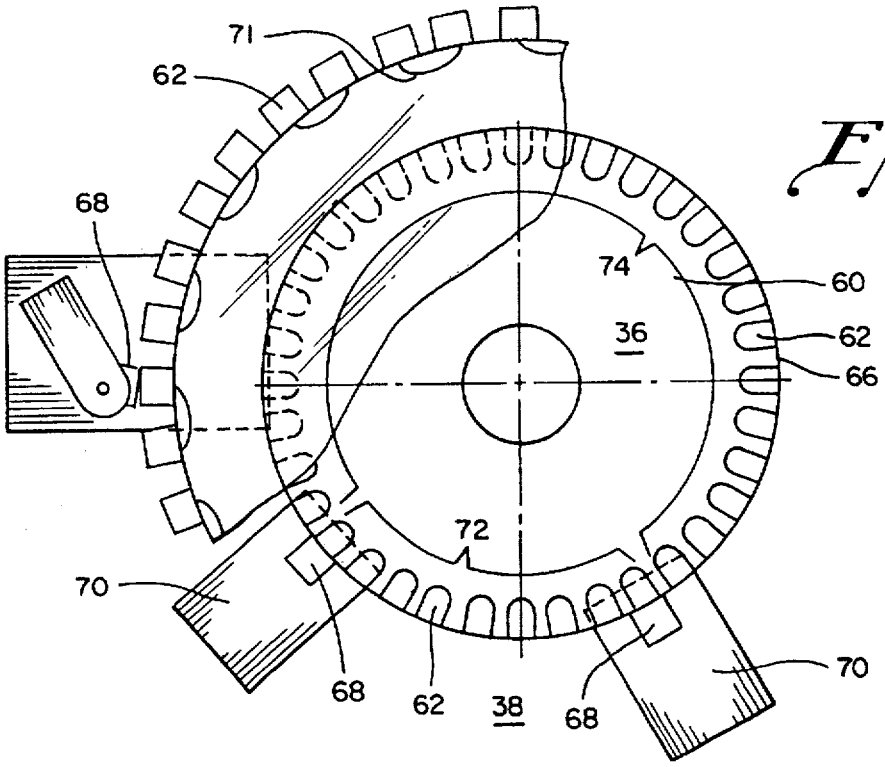
FIG. 14 is a top plan view with a partial sectional view of the vertical sealing drum.

Referring now to FIG. 1 and 14, the vertical seal former 34 includes a circular inner contact wheel or ring 60 connected to the sealing drum 36 connected for rotation therewith. The inner contact wheel 60 has a plurality of circumferentially spaced electrical contact points 62. Preferably, these points 62 are rectangularly shaped brass inserts that are mounted along a perimeter 66 of the contact wheel 60. A pair of spaced apart electrical carbon contact brushes 68 of conventional design are mounted to a plate 70 which is connected to the table 38. The brushes 68 are in pressing electrical engagement with the inner contact wheel 60. The brushes 68 are connected to a positive and negative terminals of a power supply (not shown) for producing an electrical current through the brushes 68. The contact points 62 and sealing wires 42 are electrically wired in series with a plurality of wire leads 71 connected by conventional methods to provide a first electrical path between a first set 72 of sealing wires 42 and contact points 62 and a second electrical path between a second set 74 of sealing wires 42 and contact points 62.

Since the brushes 68 remain in a fixed position, in operation, each sealing wire 42 will progressively move through the first set 72 and then the second set 74 as the sealing drum 36 rotates. Furthermore, since the contact points 62 are contained in segments, the electrical circuits formed through the first and second electrical path will have pulsating effect as the brushes 68 cross over from one contact point 62 to another.

Since the brushes 68 are not equally spaced along the perimeter of inner contact wheel 60, the first electrical path is an electrical path of least resistance and has a greater electrical current than the second electrical path. This is an important feature of allowing the vertical seals 46 to form slowly with progressively increased temperatures. Through experimentation, it has been found that an electrical current of approximately 35 volts works well. The first electrical path will generally have an electrical current in the range of 2 to 5 amps, while the second electrical path will have an electrical current in the range of 0.5 to 1.5 amps.

As was previously described, the sealing wires 42 and contact points 62 are wired together. There is an equal number of contact points 62 with sealing wires 42. Therefore, by changing the wiring configuration, it is possible to disconnect certain sealing wires 42 so that the size of the pouch 48 can be adjusted.

Figure 7:
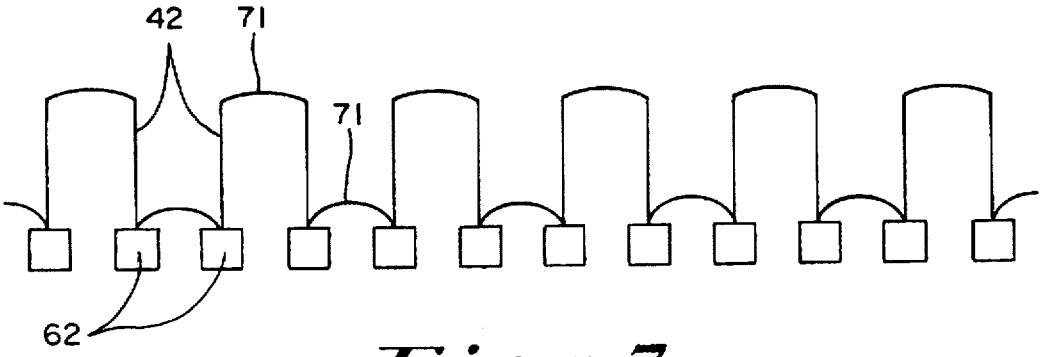
FIG. 7 is a simplified diagrammatic view of the electrical wiring of the vertical sealing drum employed in an alternative embodiment of the present invention.

For example, FIG. 7 illustrates the general concept of wiring each sealing wire 42 to a contact point 62 so that each sealing wire 42 along the sealing drum 36 will be energized. Therefore, the width of a pouch 48 will be determined by the horizontal distance between sealing wires 42.

Figure 6:
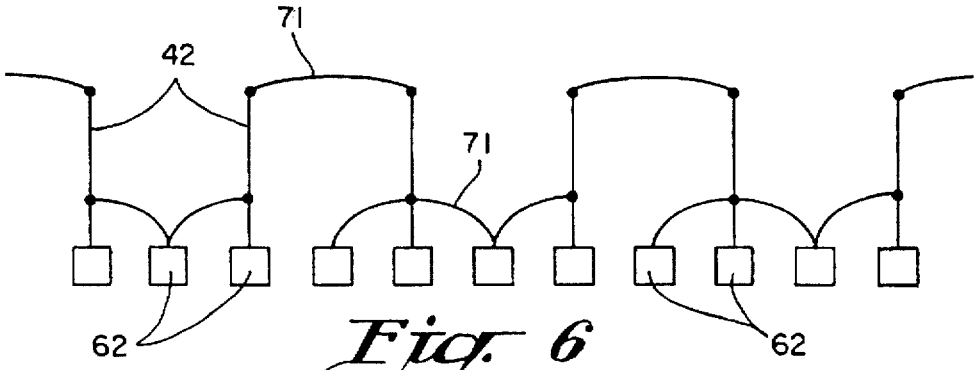
FIG. 6 is a simplified diagrammatic view of the electrical wiring of the vertical sealing drum employed in one embodiment of the present invention.

In FIG. 6, the wiring concept is provided for wiring every other sealing wire 42 so that width of the pouch 48 would be approximately double. The circuitry to accomplish the electrical wiring and electrical features previously described will be clear to those skilled in the art from the present disclosure. Alternative methods could be used to heat the wires, if desired, instead of the preferred form as shown and described herein.

Referring back to FIGS. 1 and 2, after the web 14 has been directed against the sealing drum 36, a TEFLON or elastic rubber coated belt 76 is guided and driven by rollers 78, 80, 82, and 84 for moving belt 76 in synchronized movement with the sealing drum 36 so that the belt 76 will press against the sealing drum 36 with the web 14 therebetween to provide support for the web 14 during the vertical sealing process. A press roller 86 is mounted for rotation to the table 38 in pressing engagement against the belt 76 which is against the circumferential outer surface 88 of the sealing drum 36 to aid in the severance of the vertical seals 46.

Figure 9:
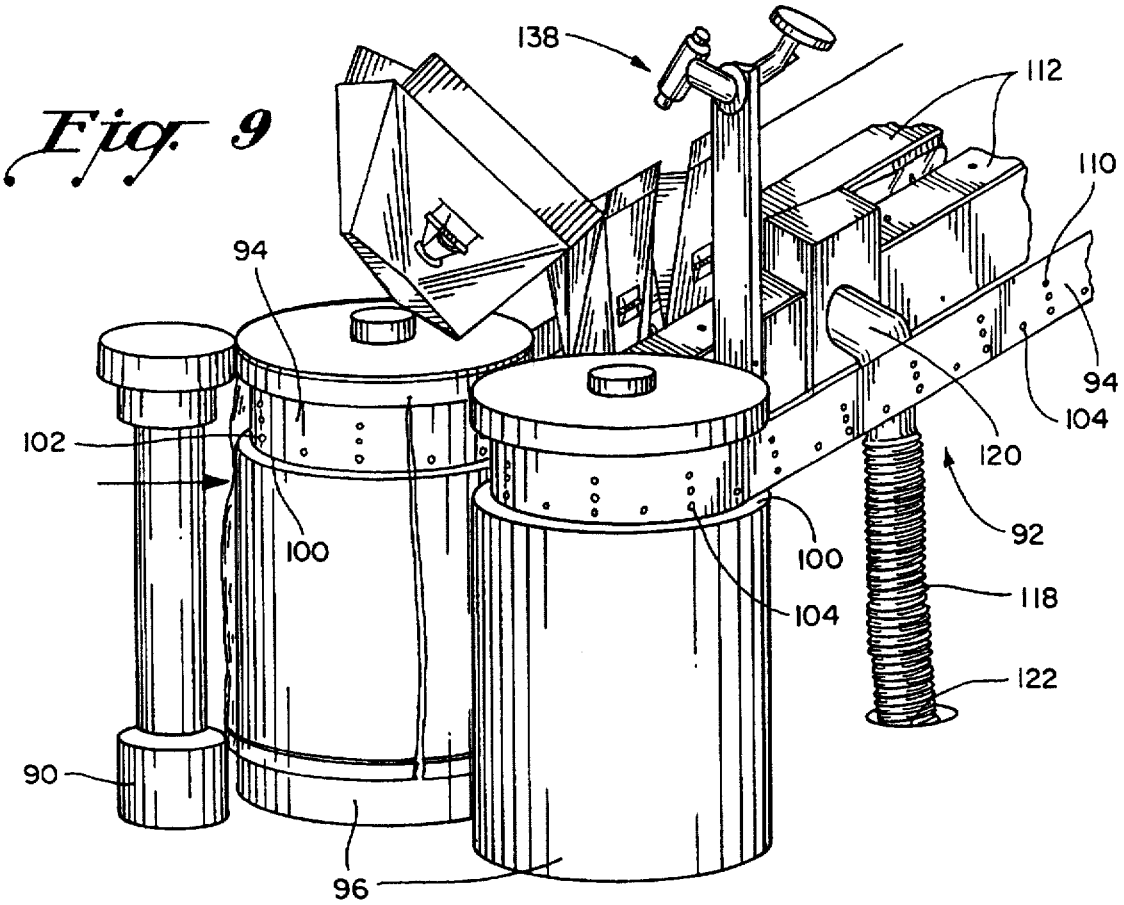
FIG. 9 is a perspective view of the pouch opening station taken in the region of line 9—9 of FIG. 2.

Referring to FIG. 9, roller 90 directs the web 14 from the vertical seal former 34 to a pouch opening station 92. The pouch opening station 92 includes a rotating a pair of vacuum belts 94 extending between front rollers 96 and back rollers 98. Preferably, the front rollers 96 have annular channels 100 for fixed positioning of the vacuum belts 94. A plurality of sprockets 102 are connected to the from rollers 96 within the channels 100 for engaging sprocket holes 104 contained in the vacuum belt 94 to prevent belt slippage, the importance of which will become clear from the following disclosures.

Confronting portions 106 of adjacent sections of the vacuum belts define an elongated channel 108. The vacuum belts 94 each having a plurality of equally spaced apart vacuum ports 110 extending through an outer surface 113 of each vacuum belt 94. Preferably, a pair of vertically aligned vacuum ports 110 are provided in a horizontally spaced apart manner, as described later.

Figure 3:
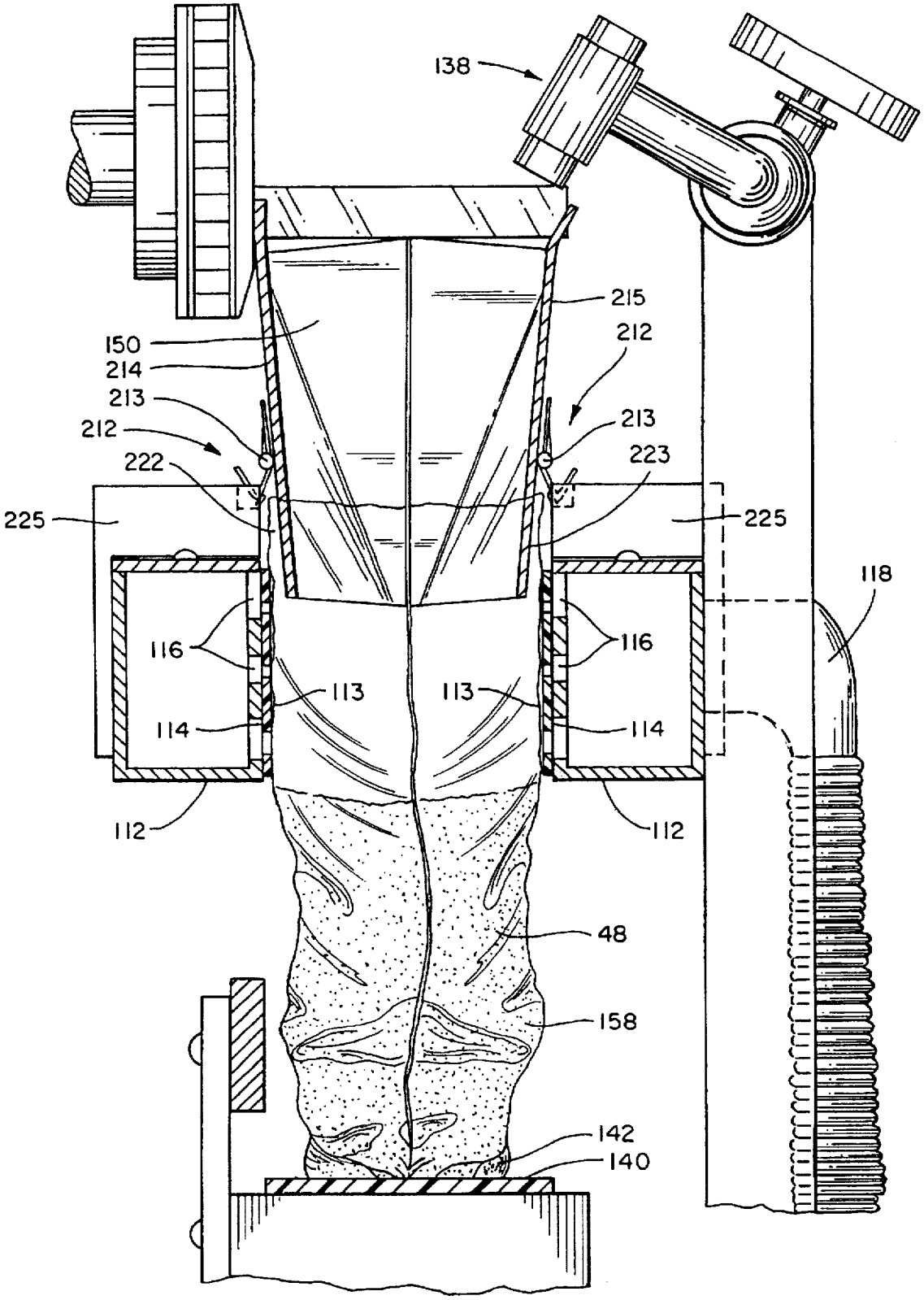
FIG. 3 is an enlarged fragmentary cross-sectional view taken along line 3—3 of FIG. 2.
Figure 8:
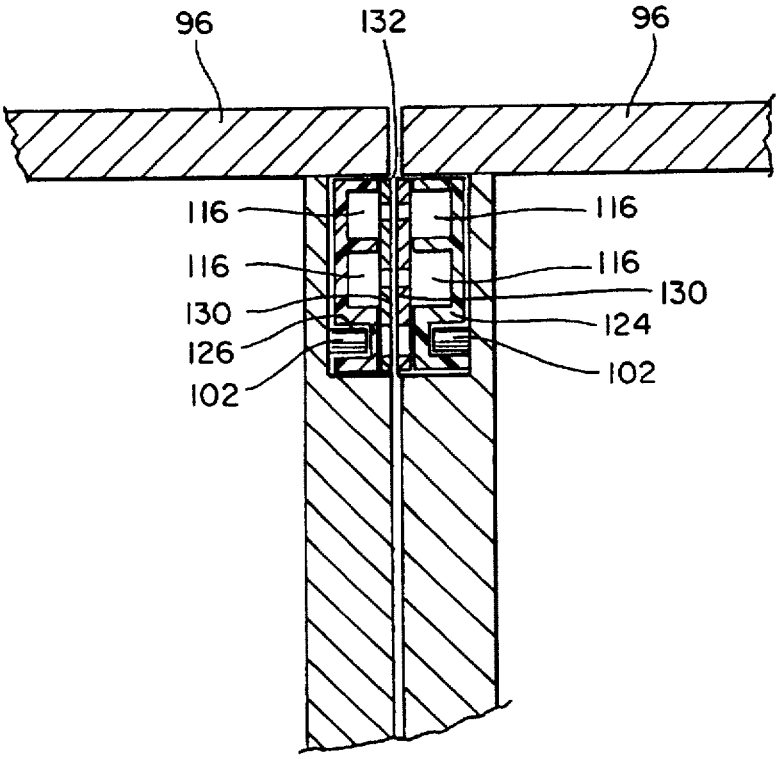
FIG. 8 is a cross-sectional view of the pouch opening station taken along line 8—8 of FIG. 10.
Figure 10:
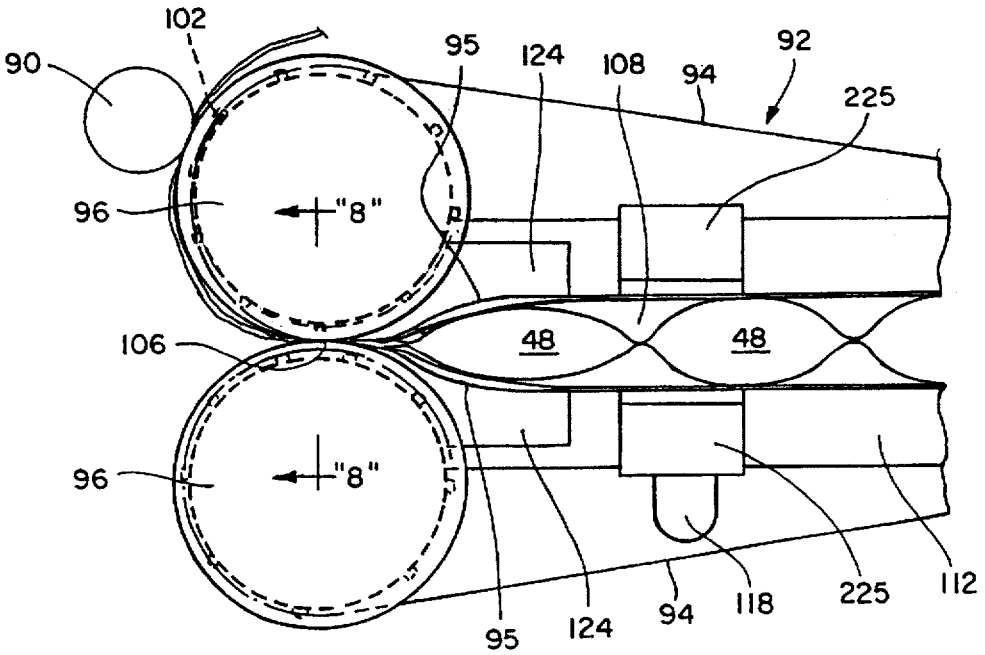
FIG. 10 is an enlarged fragmentary top plan view of the pouch opening station.

Referring to FIG. 3, a pair of suction channels 112 are provided. The channels extend between the front roller 96 and the back roller 98 and are adjacent to an inside surface 114 of the vacuum belt 94. The channels 112 have a pair of parallel elongated slots 116. The slots 116 correspond in vertical alignment with the vacuum ports 110 to allow air passage therethrough, as best shown in FIG. 3. A vacuum hose 118 has a first end 120 in air flowing connection to each channel 112. A second end 122 of the vacuum hose is connected to a vacuum device of conventional design (not shown) to produce suction forces. Preferably, 3.0 inches of Mercury (Hg) provides a suitable pressure. Each channel 112 has a leading end portion 124 (FIG. 8) extending from a first end 117 (FIG. 2) of the channel 112 and extending partially around a perimeter 95 of the front roller 96 and in spatial adjacency with a portion of the annular channel 100, as best illustrated in FIGS. 8–10. The leading end portions 124 contain the elongated slots 116 as well as a slot 126 for allowing the sprockets 102 to rotate without engagement with the leading end portion. In operation, the suction forces travel through the vacuum ports 110 of each vacuum belt 94 when the vacuum belt 94 travels through the elongated channel 108. Confronting surfaces 130 of the vacuum belts 94 define a narrow channel 132 for first directing the web 14 through when entering the pouch opening station, as shown in FIG. 8.

In operation, each successive vacuum port 110 is in approximate horizontal alignment with a center portion of each successive pouch 48 to facilitate opening of the pouch 48 as opposite outer surfaces of the opposed sidewalls 54 of each pouch 48 are progressively pulled apart by the suction force being applied from the vacuum ports 110. An air jet device 138 of conventional design is provided to aid in the separation of the opposed sidewalls of each pouch 48 by directing a stream of air at the upper portions 52 (FIG. 5) of the pouch 48 as the pouch is being first opened as passes though the narrow channel 132 (FIG. 8).

Figure 17:
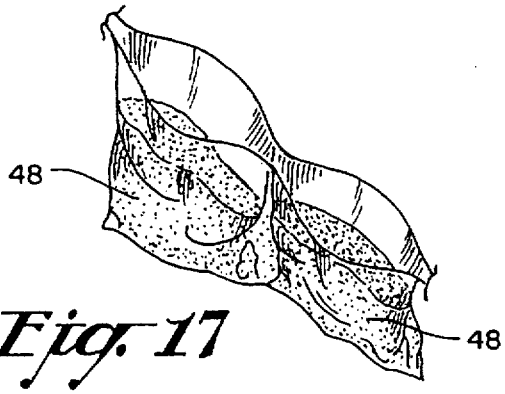
FIG. 17 is a partial perspective view filled pouches connected to the web prior to sealing and trimming of upper portions of the pouches.
Figure 18:
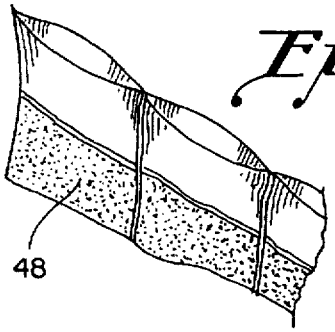
Fig. 18 PRIOR ART
FIG. 18 is a partial perspective view of filled pouches of the prior art connected to the web.

As shown in FIG. 10, while the web 14 continues through the elongated channel 108, the distance between the vacuum belts has increased to correspond to the distance that opposed sidewalls are separated. It is important to note that the horizontal spacing between the vacuum ports will be a less amount than the width of the pouches to compensate the decreased width of a pouch 48 when the sidewalls are separated. For example, it has been found that 4.0 inch spacing between vacuum ports is required when the width of the pouches is 4.5 inches. The sealed side edges 50 of each pouch 48 being severed from adjoining pouches 48 is an important improvement over the prior art, shown in FIG. 18, where the sealed side edges 50 are connected to adjoining pouches 48. In the present invention, the pouches can filled to a greater extent allowing the pouches to take on bulged shape or appearance, as shown in FIG. 17. Since the pouches 48 may filled to this extent, the width between vertical seals during the sealing process must be larger than the size of package required by the end user because additional film material must be allowed to compensate for this bulging.

Referring to FIG. 3, the pouch 48 is being shown full for illustrative purposes, recognizing that on the line 3—3 of FIG. 2 that pouch 48 would be empty. To reduce the possibility of a full pouch 48 pulling free from the suction forces holding the web 14 to the vacuum belts 94 due to gravity, an underlying conveyor 140 is provided for supporting a bottom portion 142 of the full pouch. The conveyor 140 is conventional design and is timed for synchronized movement with the web 14.

Figure 20:
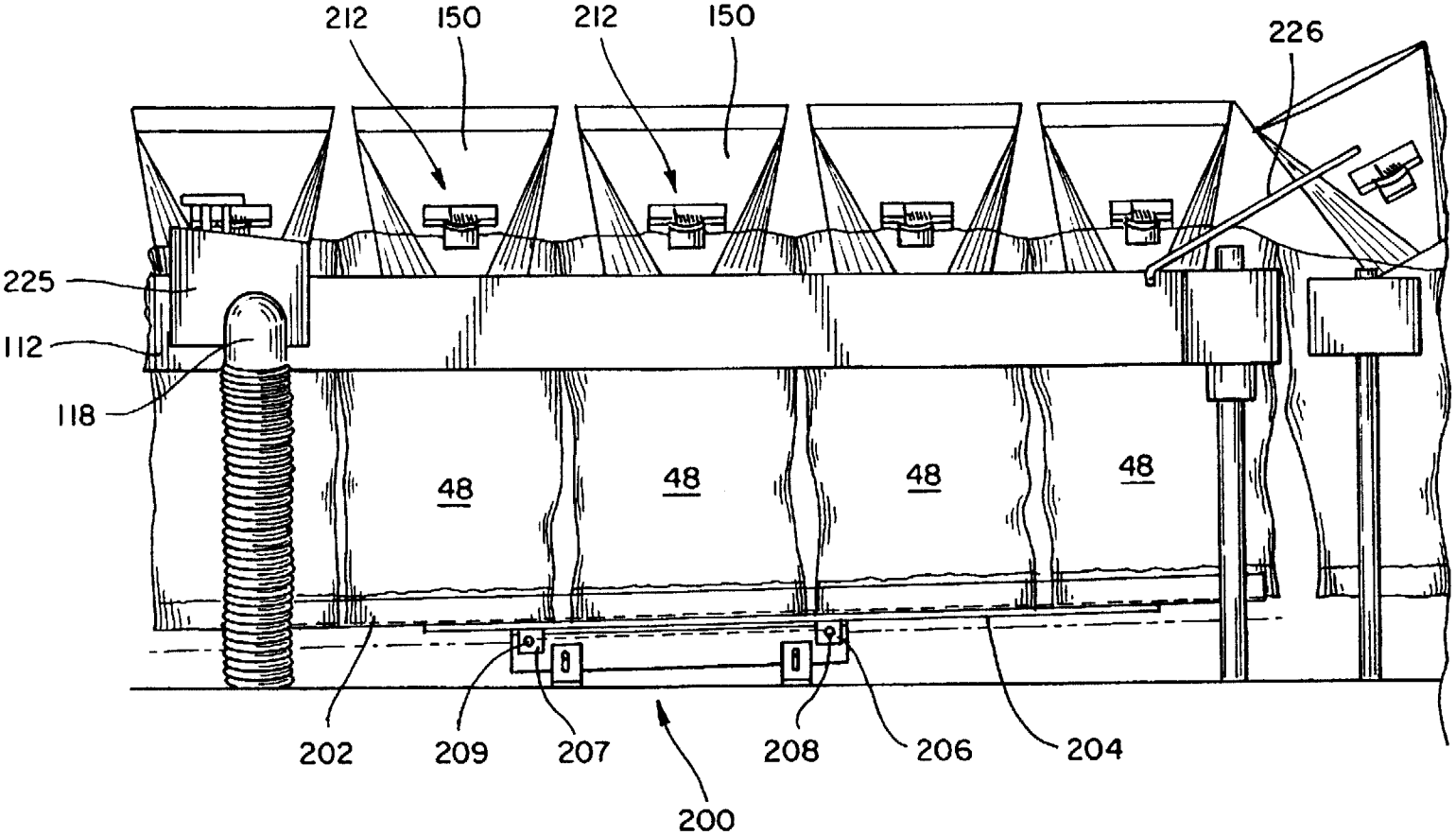
FIG. 20 is a perspective view of a bag shaking assembly of the preferred embodiment.

In a preferred embodiment shown in FIG. 20, the conveyor 140 is replaced with a bag shaking assembly 200. The bag shaking assembly creates a vibratory action that engages against a bottom portion 202 of the pouch 48 to settle the product into the bottom of the pouch as the pouch is filled. Settling of the product allows for effective filing of the pouches 48, especially in the packaging of food powder.

The bag shaking assembly 200 includes a flat elongated member 204 that vibratorily engages against the pouches 48. The elongated member 204 is connected to a pair of downwardly extending support arms 206,207 which are eccentrically mounted to a cam assembly 208,209 of conventional design. The cam assembly 208,209 is rotationally driven by a drive assembly (not shown) of conventional design. In operation, the drive assembly turns the cam assemblies 208,209 as a high rate of speed to transfer eccentric or reciprocating motion to the support arms 206,207, which in turns produces the vibratory type of the action needed to assist in settling the pouch 48 contents.

As a result of providing the stragetically located bag shaking assembly 200 in contact with the pouches 48 being filled, certain advantageous results occur. To this end, when the pouches 48 are shaken, the contents are caused to settle and or expand the sidewalls 54 of the pouches 48 to increase the volumetric capacity of each pouch, as shown in FIG. 17.

The bag shaking assembly 200 places additional strain on the forces required to support the pouches 48. Additional strain can also be created when filling pouches 48 with a heavy product. To compensate for this additional strain, a number of options are available. For example, a larger vacuum device having increased suction abilities could by used with the vacuum belt 94, as previously described, to support of the weight of the product during this bag settling process. Preferably, mechanical clips 212 are used to assist in supporting the pouches 48.

Figure 4:
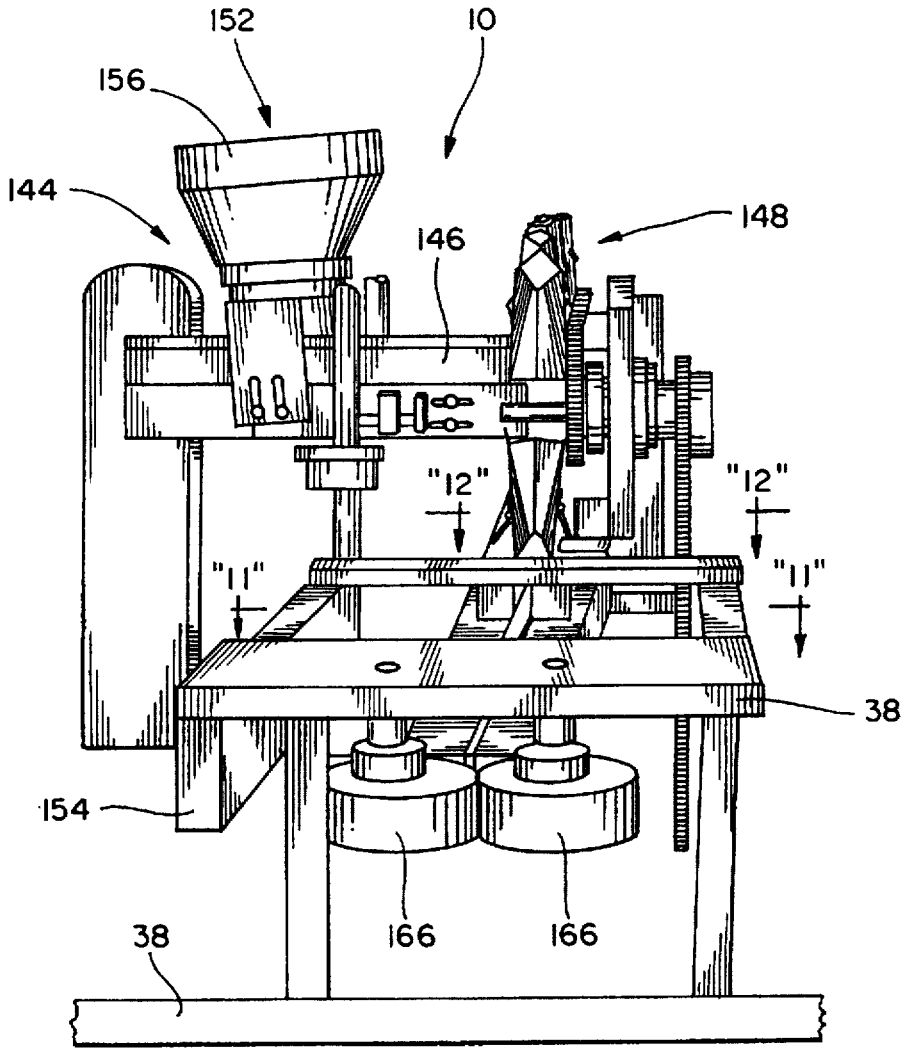
FIG. 4 is a perspective view of the present invention.

Referring to FIG. 4, a filling station 144 is provided for filling the opened pouches 48. In one embodiment designed for the packaging of food powder, a timed volumetric distribution of powder is conveyed to an underlying conveyor 146. The speed of the conveyor can be automatically timed in proportion to the speed of moving pouches. An endless chain of funnels 148 of known design is mounted for rotation so that an overlying funnel 150 will be partially inserted into each open pouch 48 while the pouch 48 is directed through the elongated channel, as shown in FIG. 3. Additionally, the speed of funnel movement is timed to the speed of the pouches.

The filling station 144 (FIG. 4) comprises a stationary product dispenser 152 mounted on a frame 154 affixed to the table 38. The dispenser 152 includes a hopper 156 for storing and feeding a product 158 (FIG. 3), such as powder. It is to be understood that other types of filling methods can be employed with the features of the present invention.

Referring to FIGS. 20-26, mechanical clips 212 are shown to prevent the pouch, as it is being filled, from pulling away from the funnel to thereby insure proper filing of the pouch. The clips 212 are pivotally mounted to both sides 214,215 (FIG. 3) of each funnel 150. The clips 212 include a hinge assembly 213 for pivoting movement and are biased with a torsion spring 217. A forward end 216 of the clip 212 has a clip pad 218 for pressingly engaging an upper portion 220 of each bag side 222,223 (FIG. 3) of the pouch 48 against a respective side 214,215 of the funnel 150. Each clip 212 has a curved extending arm member 224 for actuating the clip 212 from a closed position to an open position.

In operation, as each funnel 150 is inserted into an opened pouch 48, the arm members 224 of the clips 212 on respective sides 214,215 of the funnel 150 are engaged against a fixed track 226 of an actuating block 225 positioned on each side of the funnel 150, as shown in FIGS. 21–25. As the funnel 150 is lowered and inserted into the pouch 48, the arm members 224 push the clip 212 open to allow a respective upper portion 220 of each bag side 222,223 to be inserted between the funnel and the clip pad 218. The track 226 is sloped progressively downward to assist in lowering the funnel 150 into the pouch 48, as well as allowing the opened clip 212 to close. Once the funnel has been inserted into the pouch, the funnel has moved to a position where the track 226 ends, allowing the clip to spring into engagement against the upper portion 220 of the pouch 48. This progression is shown in FIGS. 22–25. Each pouch 48 then travels with the associated funnel 150 during the filling procedure previously described.

It should be understood that when using the mechanical clips 212, once the clips are engaged on the pouch as the web 14 travels through the elongated channel 108, the suction through the vacuum belt 94 is no longer needed and may be discontinued from this point, for example, by not extending the elongated slots 116 past this point.

Figure 26:
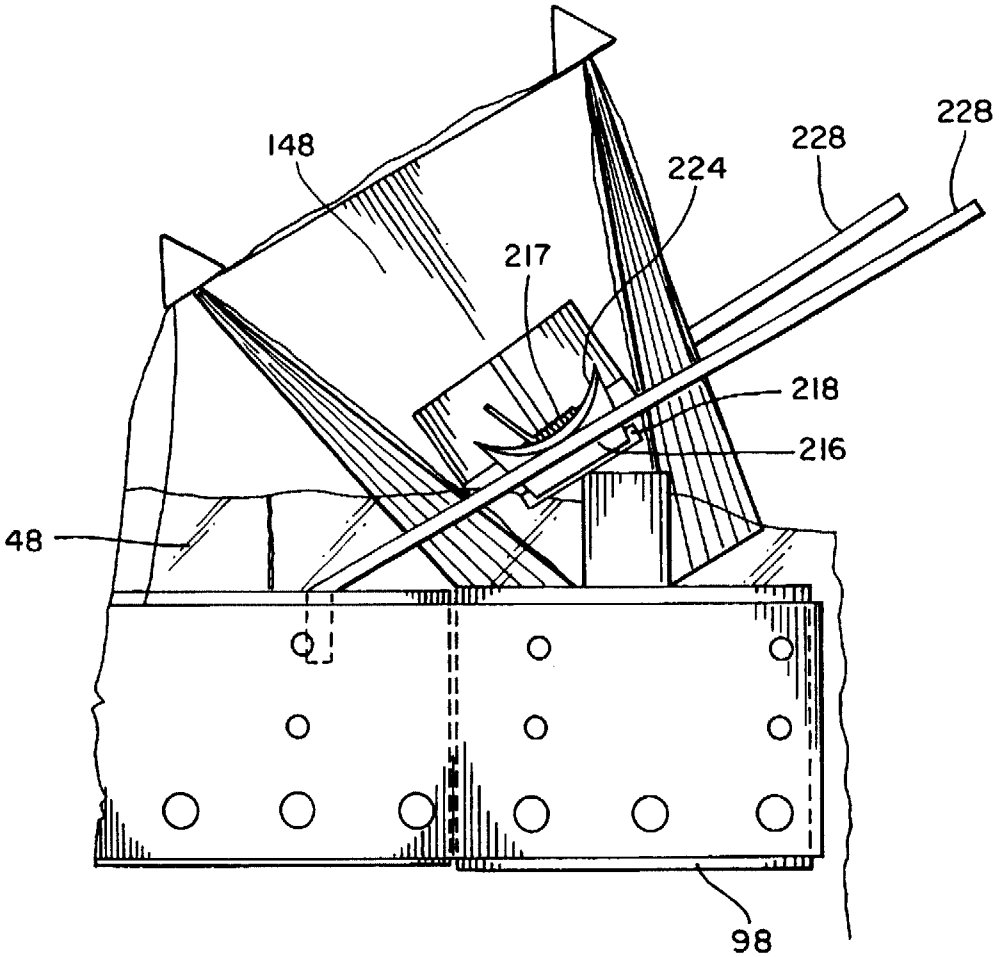
FIG. 26 is a perspective view of a mechanical clip engaged against a sloping track as the funnel is removed from an open pouch.

After each pouch 48 as been filled, the respective arm members 224 of the clips 212 on sides 214,215 of the funnel 150 are engaged against a sloping track 228 positioned on each side of the funnel, as shown in FIG. 26. Before the funnel 150 is pulled out the filled pouch 48, the arm members 224 engage the upwardly sloping track 228 to progressively push the clip 212 open to free the respective upper portion 220 of each bag side 222,223.

Referring now to FIGS. 11–13, once the pouches 48 have been filled, the web is 14 directed through a horizontal sealing device 160 and a trimming or cutoff device 162. The web 14 is driven by engaging front drive rollers 164 and engaging back rollers 166. The front drive rollers and back rollers being interconnected for rotation by TEFLON belts 168 which pressingly engage opposite sidewalls of the pouch together while the web 14 is driven between elongated retaining members 170. The retaining members 170 being operatively connected to a frame 174 have an outer sponge surfaces 172 for pressing a formed horizontal seal 176 while it cools. To form a permanent seal, a temperature of 275° F. is found to work well, whereas a peelable seal may be alternatively formed at this point, as previously described using a temperature of 160° F.

The horizontal sealing device 160 is of conventional design and uses a nichrome ribbon to form the horizontal seal 176 by sealing the top edges of the opposed sidewalls of each pouch 48 together to enclose the filled pouches 48. The horizontal seal 176 should be applied to web 14 to extend below an uppermost end 178 of the vertical seal 46. This is important so that when the trimming device 162 trims the upper portions from the web, the leading pouches will simultaneously severed from the web. The trimming device 162 is also of conventional design and known to one skilled in the art.

Figure 19:
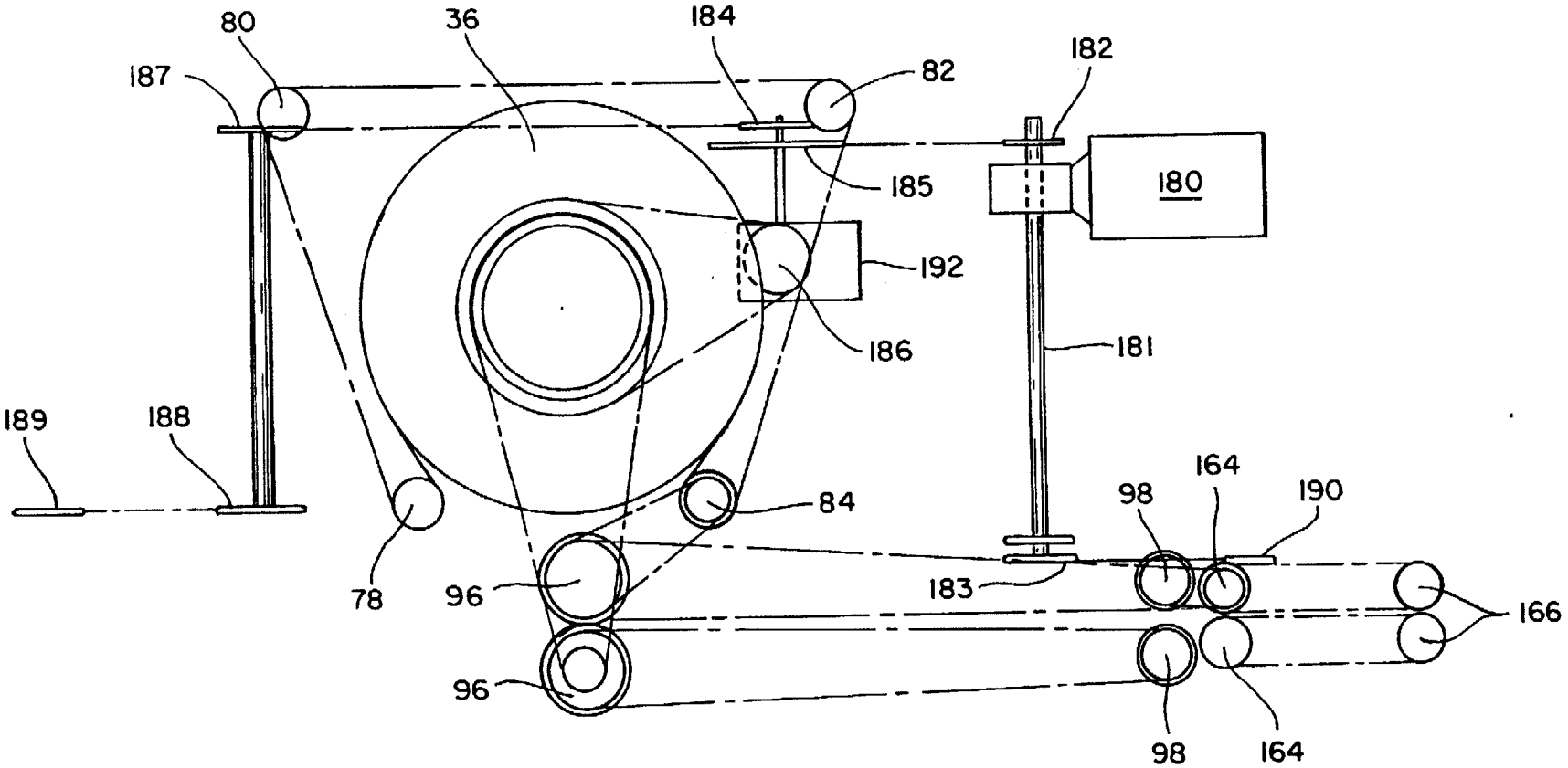
FIG. 19 is a simplified diagrammatic view illustrating the manner in which rotational drive energy is transferred from a single motor drive to the individual driven components of the present invention.

Referring to FIG. 19, a simplified diagrammatic view illustrates the manner in which rotational drive energy is transferred from a single motor drive 180 to the individual driven components with illustrated belts, pulleys, and rotating shafts. Drive assemblies for packaging machines are known in the art further description is not needed with the diagrammatic view being self explanatory to one skilled in the art. Additionally FIG. 19 corresponds to the plan view of FIG. 2.

In general, the single motor 180 is mounted below the table 38 so that all interconnected drive components will be in general synchronization with one another. The motor 180 rotates shaft 181, which turns pulleys 182, 183. Pulley 182 connects to pulleys 184, 185, which are in turn connected to a right angle gear box 192, of conventional design, that connects with pulley 186 that turns the drum 36. Pulleys 187, 188, and 189 connect with pulley 184 to transfer rotational energy to turn the web 14. Pulley 183 connects to pulley 190 which is used to operate the chain of funnels 148.

Control means provide synchronization so that elements of the drive assembly can be adjusted and timed relative to one another. This art is known and no further discussions of these control means are needed.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A method of continuously forming, filling and sealing of packages with a continuous web of fusible film material, comprising the steps of:

(a) providing the continuous web of film material;

(b) folding the web to provide confronting sides joined along a bottom edge;

(c) sealing by training the web onto a vertical seal former having plurality of vertical sealers and progressively forming each vertical seal as the web is being continuously moved with the vertical sealer while at the same applying a low temperature sealing action to allow the area of the film being sealed to be progressively forming a series of horizontally disposed pouches severed by the transversely of the web leaving sealed side edges of each pouch severed from one another with upper portions of each pouch being connected with adjoining pouches and having opposed sidewalls of each pouch unsealed along a top edge;

(d) opening pouches by separating the opposed sidewalls;

(e) filling the pouches; and (f) sealing a top portion of the opposed sidewalls of each pouch together to enclose the filled pouches.

2. The method of claim 1, further comprising the step of trimming the upper portions from the web to simultaneously sever the filled and sealed pouches from the web.

3. The method of claim 1, wherein the step of opening the pouches includes the steps of applying suction to each pouch to progressively pull the opposed sidewalls apart, and directing a stream of air at the upper portions of the pouches to aid in the separation of the opposed sidewalls of each pouch.

4. The method of claim 1, wherein the web has a surface coated with a peelable substance and the step of sealing the top edges of the opposed sidewalls of each pouch together to enclose the filled pouches provides for confronting sides coated with the peelable substance to remain manually separable by a consumer after being sealed together.

5. The method of claim 1, wherein the step of sealing by training the web onto a vertical seal former includes the steps of rotating a sealing drum of the vertical seal former having a plurality of circumferentially spaced sealing wires electrically connected in series, and providing an electrical current to the sealing drum to generate a first electrical path between a first set of sealing wires and a second electrical path between a second set of sealing wires, each sealing wire progressively moving through the first set and the second set as the sealing drum rotates.

6. The method of claim 1, further comprising the step of releasably holding upper portions of each pouch to a corresponding inserted funnel, as each pouch travels with the associated funnel.

7. The method of claim 1, further comprising the steps of supporting a bottom portion of each pouch while filling the pouch, and providing timed volumetric distribution of powder.

8. A method of continuously forming, filling and sealing of packages having a peelable seal, comprising the steps of:

(a) providing a continuous web of polyethylene film material having a surface coated with a peelable substance;

(b) folding the web to provide confronting sides coated with the peelable substance joined along a bottom edge;

(c) severing the web along the bottom edge;

(d) sealing the confronting sides along the bottom edge so that the confronting sides coated with the peelable substance can be peeled apart;

(e) forming vertical seals in the web to provide a series of horizontally disposed pouches severed by the vertical seals extending transversely of the web leaving sealed side edges of each pouch severed from one another with upper portions of each pouch being connected with adjoining pouches and having opposed sidewalls of each pouch unsealed along a top edge;

(f) opening pouches by separating the opposed sidewalls;

(g) filling the pouches;

(h) sealing a top portion of the opposed sidewalls of each pouch together to enclose the filled pouches; and (i) trimming the upper portions from the web to simultaneously sever the filled and sealed pouches from the web.

9. The method of claim 8, wherein the step of opening the pouches includes the steps of applying suction to opposite outer surfaces of the opposed sidewalls of each pouch to progressively pull the opposed sidewalls apart and directing a stream of air at the upper portions of the pouches to aid in the separation of the opposed sidewalls of each pouch.

10. The method of claim 9, further comprising the step of releasably holding upper portions of each pouch to a corresponding inserted funnel, as each pouch travels with the associated funnel.

11. The method of claim 9, further comprising the step of shaking the pouches while filling the pouches to allow contents of the pouch to settle.

12. A method of continuously forming, filling and sealing of packages, comprising the steps of:

(a) providing a continuous web of film material;

folding the web to provide confronting sides joined along a bottom edge;

(c) forming vertical seals in the web to provide a series of horizontally disposed pouches severed by the vertical seals extending transversely of the web leaving sealed side edges of each pouch severed from one another with upper portions of each pouch being connected with adjoining pouches and having opposed sidewalls of each pouch unsealed along a top edge;

(d) rotating a pair of vacuum belts mounted adjacent to one another to provide an elongated channel therebetween, the vacuum belts each having a plurality of equally spaced apart vacuum ports extending around an outer surface of each vacuum belt;

(e) applying a suction force through the vacuum ports of each vacuum belt when the vacuum belt travels through the elongated channel;

(f) directing the web through the elongated channel so that each successive vacuum port is in approximate horizontal alignment with a center portion of a successive pouch to provide opening of the pouch as opposite outer surfaces of the opposed sidewalls of each pouch are progressively pulled apart by the suction force through the vacuum port;

(g) filling the pouches; and (h) sealing the top edges of the opposed sidewalls of each pouch together to enclose the filled pouches.

13. The method of claim 12, further comprising the step of trimming the upper portions from the web to simultaneously sever the filled and sealed pouches from the web.

14. The method of claim 13, wherein the step of forming vertical seals includes sealing by training the web onto a vertical seal former having plurality of vertical sealers and progressively forming each vertical seal as the web is being continuously moved with the vertical sealer while at the same applying a low temperature sealing action to allow the area of the film being sealed to be progressively cooked.

15. A method of forming vertical seals for use in a packaging machine having a continuous web of film material having confronting sides, comprising the steps of sealing by training the web onto a vertical seal former having plurality of vertical sealers and progressively forming each vertical seal as the web is being continuously moved with the vertical sealer while at the same applying a low temperature sealing action to allow the area of the film being sealed to be progressively cooked forming a series of horizontally disposed pouches severed by the vertical seals extending transversely of the web leaving sealed side edges of each pouch severed from one another with upper portions of each pouch being connected with adjoining pouches and having opposed sidewalls of each pouch unsealed along a top edge.

16. The method of claim 15, wherein the step of sealing by training the web onto a vertical seal former includes the steps of rotating a sealing drum of the vertical seal former having a plurality of circumferentially spaced sealing wires electrically connected in series, and providing an electrical current to the sealing drum to generate a first electrical path between a first set of sealing wires and a second electrical path between a second set of sealing wires, each sealing wire progressively moving through the first set and the second set as the sealing drum rotates.

17. The method of claim 16, wherein the first electrical path is an electrical path of least resistance and has a greater electrical current than the second electrical path.

18. The method of claim 17, wherein the electrical current to the sealing drum consists of approximately 35 volts, the first electrical path having an electrical current in the range of 2 to 5 amps, and the second electrical path having an electrical current in the range of 0.5 to 1.5 amps.

19. A method of opening pouches on a continuous web of film material for use in a packaging machine, the web having horizontally disposed pouches separated by vertical seals extending transversely of the web and having opposed sidewalls of each pouch unsealed along a top edge, the method comprising of steps of:

(a) rotating a pair of vacuum belts mounted adjacent to one another to provide an elongated channel therebetween, the vacuum belts each having a plurality of equally spaced apart vacuum ports extending around an outer surface of each vacuum belt;

(b) applying a suction force through the vacuum ports of each vacuum belt when the vacuum belt travels through the elongated channel; and (c) directing the web through the elongated channel so that each successive vacuum port is in approximate horizontal alignment with a center portion of a successive pouch to provide opening of the pouch as opposite outer surfaces of the opposed sidewalls of each pouch are progressively pulled apart by the suction force through the vacuum port.

20. The method of claim 19, further comprising the step of releasably holding upper portions of each pouch to a corresponding inserted funnel, as each pouch travels with the associated funnel.

21. The method of claim 20, wherein the step of releasably holding upper portions of each pouch to a corresponding inserted funnel includes the steps of the actuating a clip connected to each side of the funnel into an open position to facilitate insertion of the funnel into an open end of the pouch, biasing the clip into a closed position to secure upper portions of the pouch in confronting engagement with respective sides of the funnel, and actuating the clip into an open position to facilitate removal of the funnel after filling of the pouch.

22. A packaging apparatus, comprising:

(a) means for feeding a continuous web of fusible film material having confronting sides;

(b) a vertical seal former having a sealing drum mounted for rotation, the sealing drum having a plurality of circumferentially spaced vertical sealers, each vertical sealer having a sealing wire mounted for pressing engagement with the web for progressively forming each vertical seal as the web is being continuously moved with the rotating sealing drum to form a series of horizontally disposed pouches severed by the vertical seals, the vertical seals extending transversely of the web from a bottom edge of the pouch to an upper portion of the pouch with the upper portions of each pouch being connected with adjoining pouches;

(c) means for opening pouches by separating opposed sidewalls of the pouches;

(d) means for filling the pouches; and (e) means for sealing a top portion of the opposed sidewalls of each pouch together to enclose the filled pouches.

23. The apparatus of claim 22, further comprising means for trimming the upper portions from the web to simultaneously sever the filled and sealed pouches from the web.

24. The apparatus of claim 22, wherein the vertical seal former includes an inner contact wheel connected to the sealing drum, the inner contact wheel having a plurality of circumferentially spaced electrical contact points, a pair of spaced apart electrical contact brushes in pressing engagement with the inner contact wheel, means for receiving an electrical current electrically connected to the brushes, and wiring means for electrically connecting the contact points and the sealing wires in series to provide a first electrical path between a first set of sealing wires and contact points and a second electrical path between a second set of sealing wires and contact points.

25. The apparatus of claim 24, wherein the wiring means is adjustable for electrically rewiring the sealing drum so that a number of sealing wires are electrically disconnected to produce horizontally disposed pouches having an increased width.

26. The apparatus of claim 24, further comprising a press roller mounted for rotation in pressing engagement against the circumferential outer surface of the sealing drum.

27. The apparatus of claim 22, wherein the means for opening the pouches includes suction means for progressively pulling the opposed sidewalls apart and air jet assist means for directing a stream of air at the upper portions of the pouches to aid in the separation of the opposed sidewalls of each pouch.

28. The apparatus of claim 27, further comprising clip means mounted to opposite sides of a funnel for securing upper portions of the pouch in confronting engagement with respective opposite sides of the funnel.

29. The apparatus of claim 28, further comprising means mounted adjacent to the filling means for actuating the clip means in an open position to facilitate insertion of the funnel into an open end of the pouch and means mounted adjacent to the filling means for actuating the clip means in the open position to facilitate removal of the funnel from the open end of the pouch after filling of the pouches has been completed.

30. The apparatus of claim 24, wherein the web has a surface coated with a peelable substance.

31. A vertical seal former device for use with a continuous web of fusible film material having confronting sides, the device comprising: a sealing drum mounted for rotation, the sealing drum having a plurality of circumferentially spaced vertical sealers, each vertical sealer having a sealing wire mounted for pressing engagement with the web for progressively forming each vertical seal as the web is being continuously moved with the rotating sealing drum to provide a series of horizontally disposed pouches severed by the vertical seals, the vertical seals extending transversely of the web from a bottom edge of the pouch to an upper portion of the pouch with the upper portions of each pouch being connected with adjoining pouches.

32. The device of claim 31, wherein an inner contact wheel is connected to the sealing drum, the inner contact wheel having a plurality of circumferentially spaced electrical contact points, a pair of spaced apart electrical contact brushes in pressing engagement with the inner contact wheel, means for receiving an electrical current electrically connected to the brushes, and wiring means for electrically connecting the contact points and the sealing wires in series to provide a first electrical path between a first set of sealing wires and contact points and a second electrical path between a second set of sealing wires and contact points.

33. The device of claim 32, wherein the wiring means is adjustable for electrically rewiring the sealing drum so that a number of sealing wires are electrically disconnected to produce horizontally disposed pouches having an increased width.

34. The device of claim 32, further comprising a press roller mounted for rotation in pressing engagement against the circumferential outer surface of the sealing drum.

35. A packaging apparatus, comprising:

(a) means for feeding a continuous web of polyethylene film material having confronting sides;

(b) means for forming vertical seals in the web to form a series of horizontally disposed pouches severed by the vertical seals, the vertical seals extending transversely of the web from a bottom edge of the pouch to an upper portion of the pouch with the upper portions of each pouch being connected with adjoining pouches;

(c) means for rotating a pair of vacuum belts rotationally mounted adjacent to one another to provide an elongated channel therebetween, the vacuum belts each having a plurality of equally spaced apart vacuum ports extending around an outer surface of each vacuum belt;

(d) means for applying a suction force through the vacuum ports of each vacuum belt when the vacuum belt travels through the elongated channel;

(e) means for directing the web through the elongated channel so that each successive vacuum port is in approximate horizontal alignment with a center portion of a successive pouch to provide opening of the pouch as opposite outer surfaces of the opposed sidewalls of each pouch are progressively pulled apart by the suction force through the vacuum ports;

(f) means for filling the pouches;

(g) means for sealing a top portion of the opposed sidewalls of each pouch together to enclose the filled pouches; and (h) means for trimming the upper portions from the web to simultaneously sever the filled and sealed pouches from the web.

36. The apparatus of claim 35, wherein the means for filling the pouches includes means for providing an endless chain of funnels mounted for rotation so that an overlying funnel will be partially inserted into each pouch, means for distributing product into the overlying funnel to fill each pouch, and means for shaking the pouches while filling the pouches to allow contents of the pouch to settle.

37. The apparatus of claim 35, wherein the means for forming vertical seals in the web includes a vertical seal former having a sealing drum mounted for rotation, the sealing drum having a plurality of circumferentially spaced vertical sealers, each vertical sealer having a sealing wire mounted for pressing engagement with the web for progressively forming each vertical seal as the web is being continuously moved with the rotating sealing drum.

38. The apparatus of claim 37, wherein an inner contact wheel is connected to the sealing drum, the inner contact wheel having a plurality of circumferentially spaced electrical contact points, a pair of spaced apart electrical contact brushes in pressing engagement with the inner contact wheel, means for receiving an electrical current electrically connected to the brushes, and wiring means for electrically connecting the contact points and the sealing wires in series to provide a first electrical path between a first set of sealing wires and contact points and a second electrical path between a second set of sealing wires and contact points.

39. The apparatus of claim 36, further comprising clip means mounted to opposite sides of the funnel for securing upper portions of the pouch in confronting engagement with respective opposite sides of the funnel.

40. The apparatus of claim 39, further comprising means mounted adjacent to the filling means for actuating the clip means in an open position to facilitate insertion of the funnel into an open end of the pouch and means mounted adjacent to the filling means for actuating the clip means in the open position to facilitate removal of the funnel from the open end of the pouch after filling of the pouches has been completed.

41. A packaging apparatus for opening pouches on a continuous web of film material, the web having horizontally disposed pouches separated by vertical seals extending transversely of the web and having opposed sidewalls of each pouch unsealed along a top edge, the apparatus comprising:

(a) means for rotating a pair of vacuum belts rotationally mounted adjacent to one another to provide an elongated channel therebetween, the vacuum belts each having a plurality of equally spaced apart vacuum ports extending around an outer surface of each vacuum belt;

(b) means for applying a suction force through the vacuum ports of each vacuum belt when the vacuum belt travels through the elongated channel;

(c) means for directing the web through the elongated channel so that each successive vacuum port is in approximate horizontal alignment with a center portion of a successive pouch to provide opening of the pouch as opposite outer surfaces of the opposed sidewalls of each pouch are progressively pulled apart by the suction force through the vacuum ports.

42. The apparatus of claim 41, further comprising means for providing an endless chain of funnels mounted for rotation so that an overlying funnel will be partially inserted into each open pouch while the pouch is directed through the elongated channel, and means for distributing product into the overlying funnel to fill each pouch.

43. The apparatus of claim 42, further comprising clip means mounted to opposite sides of the funnel for securing upper portions of the pouch in confronting engagement with respective opposite sides of the funnel.

44. A method of continuously forming, filling and sealing of packages with a continuous web of fusible film material, comprising the steps of:

(a) providing the continuous web of film material, the web having a surface coated with a peelable substance;

(b) folding the web to provide confronting sides joined along a bottom edge;

(c) sealing by training the web onto a vertical seal former having plurality of vertical sealers and progressively forming each vertical seal as the web is being continuously moved with the vertical sealer while at the same applying a low temperature sealing action to allow the area of the film being sealed to be progressively melted forming a series of horizontally disposed pouches severed by the vertical seals extending transversely of the web leaving sealed side edges of each pouch severed from one another with upper portions of each pouch being connected with adjoining pouches and having opposed sidewalls of each pouch unsealed along a top edge;

(d) opening pouches by separating the opposed sidewalls;

(e) filling the pouches; and (f) sealing a top portion of the opposed sidewalls of each pouch together to enclose the filled pouches with confronting sides coated with the peelable substance remaining manually separable by a consumer after being sealed together.

45. A method of continuously forming, filling and sealing of packages with a continuous web of fusible film material, comprising the steps of:

(a) providing the continuous web of film material;

(b) folding the web to provide confronting sides joined along a bottom edge;

(c) sealing by training the web onto a vertical seal former having plurality of vertical sealers and progressively forming each vertical seal as the web is being continuously moved with the vertical sealer while at the same applying a low temperature sealing action to allow the area of the film being sealed to be progressively melted forming a series of horizontally disposed pouches severed by the vertical seals extending transversely of the web leaving sealed side edges of each pouch severed from one another with upper portions of each pouch being connected with adjoining pouches and having opposed sidewalls of each pouch unsealed along a top edge, and wherein the step of sealing by training the web onto a vertical seal former includes the steps of rotating a sealing drum of the vertical seal former having a plurality of circumferentially spaced sealing wires electrically connected in series, and providing an electrical current to the sealing drum to generate a first electrical path between a first set of sealing wires and a second electrical path between a second set of sealing wires, each sealing wire progressively moving through the first set and the second set as the sealing drum rotates;

(d) opening pouches by separating the opposed sidewalls;

(e) filling the pouches; and (f) sealing a top portion of the opposed sidewalls of each pouch together to enclose the filled pouches.

46. A method of forming vertical seals for use in a packaging machine having a continuous web of film material having confronting sides, comprising the steps of sealing by training the web onto a vertical seal former having plurality of vertical sealers and progressively forming each vertical seal as the web is being continuously moved with the vertical sealer while at the same applying a low temperature sealing action to allow the area of the film being sealed to be progressively melted forming a series of horizontally disposed pouches severed by the vertical seals extending transversely of the web leaving sealed side edges of each pouch severed from one another with upper portions of each pouch being connected with adjoining pouches and having opposed sidewalls of each pouch unsealed along a top edge, wherein the step of sealing by training the web onto a vertical seal former includes the steps of rotating a sealing drum of the vertical seal former having a plurality of circumferentially spaced sealing wires electrically connected in series, and providing an electrical current to the sealing drum to generate a first electrical path between a first set of sealing wires and a second electrical path between a second set of sealing wires, each sealing wire progressively moving through the first set and the second set as the sealing drum rotates.

47. The method of claim 46, wherein the first electrical path is an electrical path of least resistance and has a greater electrical current than the second electrical path.

48. The method of claim 47, wherein the electrical current to the sealing drum consists of approximately 35 volts, the first electrical path having an electrical current in the range of 2 to 5 amps, and the second electrical path having an electrical current in the range of 0.5 to 1.5 amps.

49. A packaging apparatus, comprising:

(a) means for feeding a continuous web of fusible film material having confronting sides;

(b) a vertical seal former having a sealing drum mounted for rotation, the sealing drum having a plurality of circumferentially spaced vertical sealers, each vertical sealer having a sealing wire mounted for pressing engagement with the web for progressively forming each vertical seal as the web is being continuously moved with the rotating sealing drum to form a series of horizontally disposed pouches severed by the vertical seals, the vertical seals extending transversely of the web from a bottom edge of the pouch to an upper portion of the pouch with the upper portions of each pouch being connected with adjoining pouches, the vertical seal former including an inner contact wheel connected to the sealing drum, the inner contact wheel having a plurality of circumferentially spaced electrical contact points, a pair of spaced apart electrical contact brushes in pressing engagement with the inner contact wheel, means for receiving an electrical current electrically connected to the brushes, and wiring means for electrically connecting the contact points and the sealing wires in series to provide a first electrical path between a first set of sealing wires and contact points and a second electrical path between a second set of sealing wires and contact points;

(c) means for opening pouches by separating opposed sidewalls of the pouches;

(d) means for filling the pouches; and (e) means for sealing a top portion of the opposed sidewalls of each pouch together to enclose the filled pouches.

50. The apparatus of claim 49, wherein the wiring means is adjustable for electrically rewiring the sealing drum so that a number of sealing wires are electrically disconnected to produce horizontally disposed pouches having an increased width.

51. The apparatus of claim 49, further comprising a press roller mounted for rotation in pressing engagement against the circumferential outer surface of the sealing drum.

52. A packaging apparatus, comprising:

(a) means for feeding a continuous web of fusible film material having confronting sides;

(b) a vertical seal former having a sealing drum mounted for rotation, the sealing drum having a plurality of circumferentially spaced vertical sealers, each vertical sealer having a sealing wire mounted for pressing engagement with the web for progressively forming each vertical seal as the web is being continuously moved with the rotating sealing drum to form a series of horizontally disposed pouches severed by the vertical seals, the vertical seals extending transversely of the web from a bottom edge of the pouch to an upper portion of the pouch with the upper portions of each pouch being connected with adjoining pouches;

(c) means for opening pouches by separating opposed sidewalls of the pouches, the means for opening the pouches including suction means for progressively pulling the opposed sidewalls apart and air jet assist means for directing a stream of air at the upper portions of the pouches to aid in the separation of the opposed sidewalls of each pouch;

(d) clip means mounted to opposite sides of a funnel for securing upper portions of the pouch in confronting engagement with respective opposite sides of the funnel (e) means for filling the pouches; and (f) means for sealing a top portion of the opposed sidewalls of each pouch together to enclose the filled pouches.

53. The apparatus of claim 52, further comprising means mounted adjacent to the filling means for actuating the clip means in an open position to facilitate insertion of the funnel into an open end of the pouch and means mounted adjacent to the filling means for actuating the clip means in the open position to facilitate removal of the funnel from the open end of the pouch after filling of the pouches has been completed.

54. A packaging apparatus, comprising:

(a) means for feeding a continuous web of fusible film material having confronting sides, the web having a surface coated with a peelable substance;

(b) a vertical seal former having a sealing drum mounted for rotation, the sealing drum having a plurality of circumferentially spaced vertical sealers, each vertical sealer having a sealing wire mounted for pressing engagement with the web for progressively forming each vertical seal as the web is being continuously moved with the rotating sealing drum to form a series of horizontally disposed pouches severed by the vertical seals, the vertical seals extending transversely of the web from a bottom edge of the pouch to an upper portion of the pouch with the upper portions of each pouch being connected with adjoining pouches, the vertical seal former including an inner contact wheel connected to the sealing drum, the inner contact wheel having a plurality of circumferentially spaced electrical contact points, a pair of spaced apart electrical contact brushes in pressing engagement with the inner contact wheel, means for receiving an electrical current electrically connected to the brushes, and wiring means for electrically connecting the contact points and the sealing wires in series to provide a first electrical path between a first set of sealing wires and contact points and a second electrical path between a second set of sealing wires and contact points;

(c) means for opening pouches by separating opposed sidewalls of the pouches;

(d) means for filling the pouches; and (e) means for sealing a top portion of the opposed sidewalls of each pouch together to enclose the filled pouches.

55. A vertical seal former device for use with a continuous web of fusible film material having confronting sides, the device comprising: a sealing drum mounted for rotation, the sealing drum having a plurality of circumferentially spaced vertical sealers, each vertical sealer having a sealing wire mounted for pressing engagement with the web for progressively forming each vertical seal as the web is being continuously moved with the rotating sealing drum to provide a series of horizontally disposed pouches severed by the vertical seals, the vertical seals extending transversely of the web from a bottom edge of the pouch to an upper portion of the pouch with the upper portions of each pouch being connected with adjoining pouches, and an inner contact wheel being connected to the sealing drum, the inner contact wheel having a plurality of circumferentially spaced electrical contact points, a pair of spaced apart electrical contact brushes in pressing engagement with the inner contact wheel, means for receiving an electrical current electrically connected to the brushes, and wiring means for electrically connecting the contact points and the sealing wires in series to provide a first electrical path between a first set of sealing wires and contact points and a second electrical path between a second set of sealing wires and contact points.

56. The device of claim 55, wherein the wiring means is adjustable for electrically rewiring the sealing drum so that a number of sealing wires are electrically disconnected to produce horizontally disposed pouches having an increased width.

57. The device of claim 55, further comprising a press roller mounted for rotation in pressing engagement against the circumferential outer surface of the sealing drum.

58. A method of forming vertical seals for use in a packaging machine having a continuous web of fusible paper-free film material having confronting sides, comprising the steps of sealing by training the web onto a vertical seal former having plurality of vertical sealers and progressively forming each vertical seal as the web is being continuously moved with the vertical sealer while at the same applying a low temperature sealing action to allow the area of the film being sealed to be progressively melted along a sealing wire of each vertical sealer forming a series of horizontally disposed pouches severed by the vertical seals extending transversely of the web leaving sealed side edges of each pouch severed from one another with upper portions of each pouch being connected with adjoining pouches and having opposed sidewalls of each pouch unsealed along a top edge, and holding the web against the vertical seal former during sealing with a pressing action of a belt moving in synchronized motion with the web.

59. A vertical seal former for use with a continuous web of fusible paper-free film material having confronting sides, the device comprising: a sealing drum mounted for rotation, the sealing drum having a plurality of circumferentially spaced vertical sealers, each vertical sealer having a sealing wire mounted for pressing engagement with the web for progressively forming each vertical seal as the web is being continuously moved with the rotating sealing drum to provide a series of horizontally disposed pouches severed by the vertical seals, the vertical seals extending transversely of the web from a bottom edge of the pouch to an upper portion of the pouch with the upper portions of each pouch being connected with adjoining pouches, and a belt moving in synchronized motion with the web in pressing engagement against the sealing drum with the web therebetween.

60. The vertical seal former of claim 59, wherein the continuous web of fusible paper-free film material is formed of polyethylene.

* * * * *